US005484298A

United States Patent [19]

Flum et al.

[11] Patent Number: 5,484,298

[45] Date of Patent: Jan. 16, 1996

[54] SELF-TERMINATING XLR CONNECTOR DEVICE

[75] Inventors: Alan Flum; Michael A. Zampini, both of Boca Raton; Norman A. Allum, Boynton Beach, all of Fla.

[73] Assignees: Sony Corporation, Tokyo, Japan; Sony Electronics Inc., Park Ridge, N.J.

[21] Appl. No.: 193,538

[22] Filed: Feb. 8, 1994

[51] Int. Cl.[6] ..... H01R 13/703

[52] U.S. Cl. ..... 439/188; 439/488

[58] Field of Search ..... 439/188, 488, 439/489, 490; 200/51.09, 51.10, 5111

[56] References Cited

U.S. PATENT DOCUMENTS

| | | | |
|---|---|---|---|
| 4,118,690 | 10/1978 | Paynton | 439/440 |
| 4,179,173 | 12/1979 | Rise, III | 439/188 |
| 5,030,122 | 7/1991 | Birch et al. | 439/188 |
| 5,352,128 | 10/1994 | Bricaud | 439/188 |

FOREIGN PATENT DOCUMENTS

| | | | |
|---|---|---|---|
| 0395514 | 10/1990 | European Pat. Off. | 439/188 |
| 0077885 | 3/1989 | Japan | 439/188 |
| 0309578 | 12/1990 | Japan | 439/188 |

OTHER PUBLICATIONS

Markertek Video Supply Catalog, p. 4 (undated).

*Primary Examiner*—Larry I. Schwartz
*Assistant Examiner*—Hien D. Vu
*Attorney, Agent, or Firm*—Ronald P. Kananen

[57] ABSTRACT

Disclosed is an improved XLR connector which automatically terminates at least two of the matable connecting terminals of the XLR connector when the XLR connector is not attached to another XLR connector. The XLR connector includes a spring-biased switching member which opens and closes depending on whether the XLR connector is attached to another XLR connector. According to a first embodiment of the invention, an internal resistor is provided in the XLR connector which has a resistance that matches the impedance of the signal lines coupled to the XLR connector. According to a second embodiment, two additional terminals are provided on the XLR connector which are coupled together through the switching member. Thus, the state of the XLR connector may be detected by detecting the potential difference between the two additional terminals.

8 Claims, 5 Drawing Sheets

SELF-TERMINATING XLR CONNECTOR DEVICE

FIELD OF THE INVENTION

This invention relates to an improved XLR connector device for connecting electrical apparatuses. More particularly, it relates to a self-terminating XLR connector.

BACKGROUND OF THE INVENTION

In the electrical arts, various types of connectors are utilized for a wide variety of applications. Particularly in the professional audio field, XLR connectors are currently the industry-standard connector. XLR connectors are available in either male or female types and may be used to connect three conductive wires attached to contact areas on the connector with a complementary XLR connector. Each of the three wires may conduct an electric signal, for example, the three wires may provide HIGH, LOW and SHIELD signals to an attached device.

In many instances, although a device is connected to the XLR connector, the XLR connector itself remains unattached from a corresponding, matable connector. In such cases, the three lines connected to the device remain open. This may lead to the introduction of unwanted noise in the attached device. Such noise may be reduced or eliminated in different ways. For instance, if the input from the connector to the device is coupled to an adjustable input amplifier, the amplifier may simply be turned down. Alternatively, a so-called terminating connector may be attached to the connector which is in use. The terminating connector shorts two of the lines together thereby forming a closed circuit. For example, in the audio field, it is typical to short pin #3 with pin #2.

Noise may arise from a failure to properly terminate the signal lines coupled to an attached device. According to a conventional technique, this noise is eliminated by coupling the open signal line to ground with a resistor having an impedance that matches the impedance of the line. For a typical cable, a 600Ω resistor is used. Thus, if a line having an active signal is connected to a first XLR connector which in turn is matably attached to a second XLR connector, the line will usually be terminated on a printed circuit board by a matched resistor coupled to ground. However, when the first XLR connector is disconnected from the second XLR connector, the lines coupled to the first XLR connector will no longer be properly terminated. A resistor may be attached to connect the signal line to ground, but this involves soldering a resistor to the line each time the XLR is disconnected. Therefore, conventional solutions to the aforementioned problems are not time-efficient in that they require the operator actively to connect a terminator, to turn down amplification or to attach an external resistor.

Moreover, apart from resulting noise, conventional arrangements do not provide an input to the attached device which indicates that the signal lines to the XLR connector are open. Thus, it is necessary for the user to physically inspect the attached lines to ensure that each-XLR connector is attached as desired, thereby resulting in added burden.

Accordingly, there is a need to provide improved XLR connectors which are self-terminating. That is, there is a need to provide an XLR connector which properly terminates otherwise open signal lines when the XLR connector is unattached to another device, but permits the lines to transmit signals in a normal fashion when the XLR connector couples two devices together. There is a related need to provide an XLR connector which automatically indicates that it is not connected to a corresponding XLR connector.

SUMMARY OF THE INVENTION

It is an object of the invention to meet these and other needs by providing a self-terminating XLR connector device matably connectable to a second connector device, comprising a plurality of terminals each having a first portion for matably attaching to a corresponding terminal of the second connector device and a second portion for establishing an electrical connection with a signal line, and a movable switching member. The movable switching member detects when the self-terminating XLR connecting device is matably connected with the second connecting device by having a first position when the self-terminating XLR connecting device is matably connected to the second connector device and a second position when the self-terminating XLR device is unconnected to the second connecting device. In this way, the movable switching member opens an electrical path between a first conductive element and a second conductive element when in the first position and closes the electrical path when in the second position.

According to a first aspect of the invention, this electrical path connects at least two of the terminals of the XLR connector. An internal resistor is provided in this electrical path which has a resistance substantially equal to the impedance of the signal lines.

According to a second aspect of the invention, the electrical path leads to two additional external terminals whereby the position of the switching member may be determined by measuring the potential difference between the two additional external terminals.

DETAILED DESCRIPTION OF THE PREFERRED EMBODIMENTS

Figure 1:
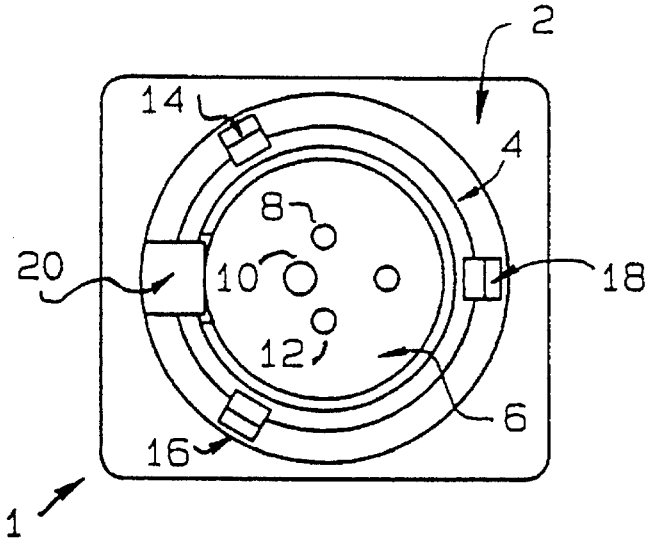
FIG. 1 PRIOR ART
FIG. 1 is an end perspective of a conventional male-type XLR connector.

FIG. 1 shows an end perspective of a conventional male-type XLR connector 1. The XLR connector comprises an outer metal casing 2 in which a circular opening 4 is formed. A cylindrically-shaped inner portion 6 is concentrically formed inside the circular opening 4. Within this inner portion 6 are located three pins 8, 10 and 12, each of which are connected to conductive terminals on the rear portion of the XLR connector (not shown). Through this arrangement, wires may be attached to the terminals, thereby coupling the wires to the pins 8, 10 and 12 in the inner portion.

A female XLR connector may be connected with the male XLR connector by inserting the female XLR connector within the inner portion 6. The pins 8, 10 and 12 of the male XLR connector 1 are thereby placed in contact with metal tubular-shaped terminals located in the female XLR connector (not shown). The two XLR connectors are held together by flexible, spring-like portions 14, 16 and 18 of the male XLR connector located above the inner portion 6. These spring-like portions 14, 16 and 18 exert a bias force against the female XLR connector. The male XLR connector further includes a ridge-like protrusion 20 which extends a small distance within the inner portion 6. This protrusion 20 locks together with a spring-biased portion of the female XLR connector.

Figure 2:
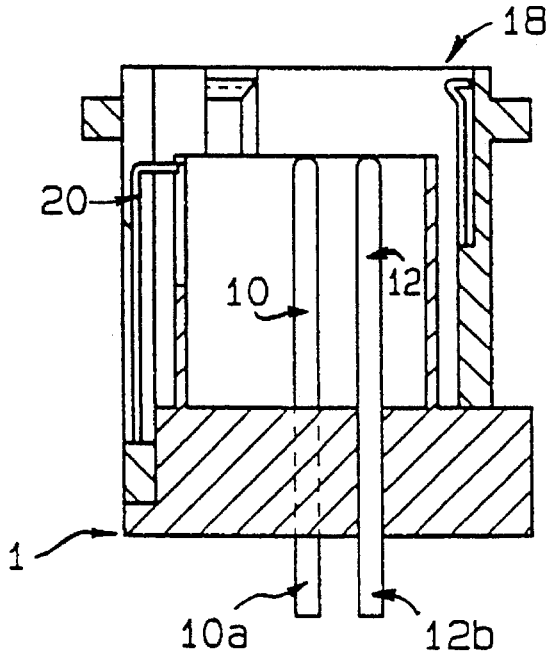
FIG. 2 PRIOR ART
FIG. 2 is a cross-sectional side perspective of a conventional male-type XLR connector.

FIG. 2 shows a cross-sectional side perspective of the male connecter 1 shown in FIG. 1. From this view, two of the pins 10 and 12 are shown. Each of the pins 10 and 12 have end portions 10*a* and 12*b* which serve as terminals by which wires may be attached to the XLR connector 1.

Figure 3A:
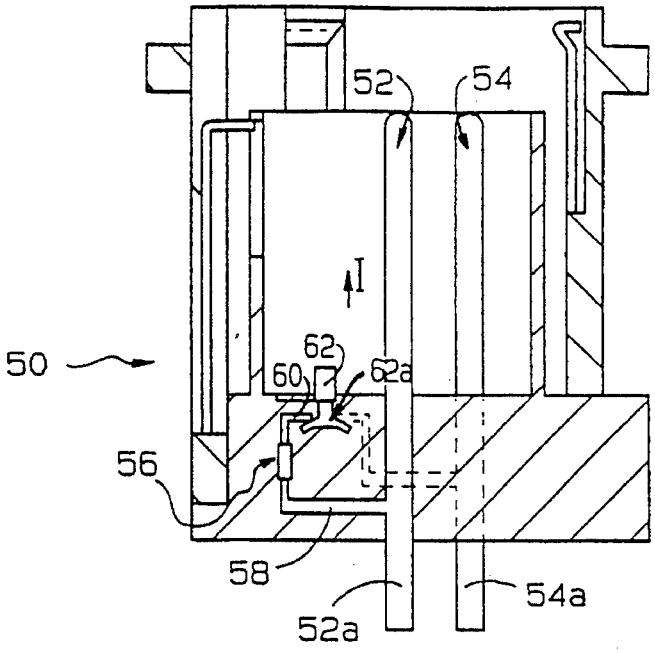
FIG. 3A is a cross-sectional side perspective of a male-type XLR connector according to the present invention in a disconnected position.

FIG. 3A is a cross-sectional view of a male-type XLR connector 50 according to the present invention. The XLR connector 50 has three pins, two of which 52 and 54 are shown. The pins 52 and 54 each have respective end portions 52*a* and 54*a* which serve as terminals by which the XLR connector may be coupled to a device. The end portion 52*a* is connected to an internal resistor 56 via a conductive portion 58. The other terminal of the resistor 56 is attached to a conductive strip 60 which has a gap formed therein.

In the gap 60, a switching member 62 is placed which has an end portion having a conducting strip 62*a*. As shown in FIG. 3A, the switching member 62 is spring-biased upwards in a direction I (extending outward from the XLR connector as shown). This results in the conduction strip 62*a* closing an electrical path between the pins 52 and 54 via the internal resistor 56.

The internal resistor 56 has a predetermined value which is equal to the impedance of the wires which are to be coupled to the pins 52 and 54. Typically, the resistor will have a value of 600 ohms. However, resistors with different values may be used according to the desired application.

Figure 3B:
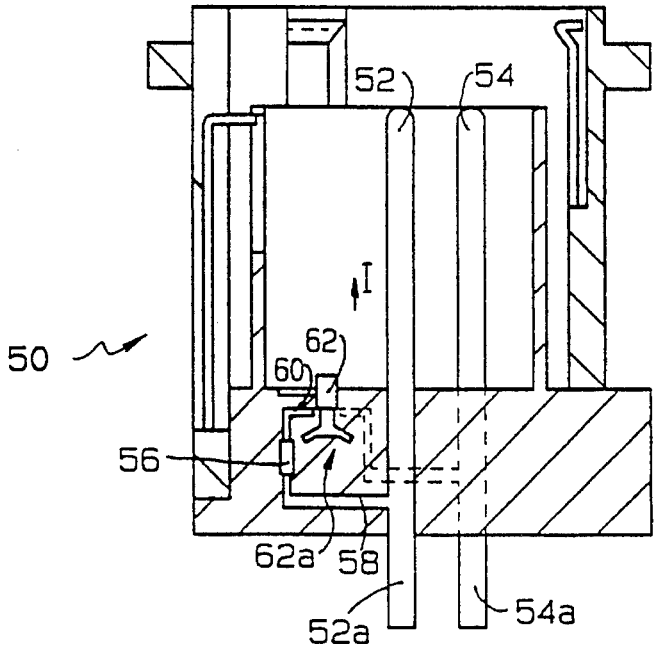
FIG. 3B is a cross-sectional side perspective of a male-type XLR connector according to the present invention in a connected position.

When a female XLR connector is inserted (not shown) into the male XLR connector 50, a surface of the female XLR connector exerts a force which depresses the switching member in a direction opposite to direction I. As shown in FIG. 3B, this force displaces the conducting strip 62*a*, thereby opening the electrical path formed between the terminals 52 and 54 via resistor 60. Thus, when unattached to another XLR connector, two of the pins 60 and 62 automatically are shorted, thereby terminating any lines attached thereto.

Figure 4A:
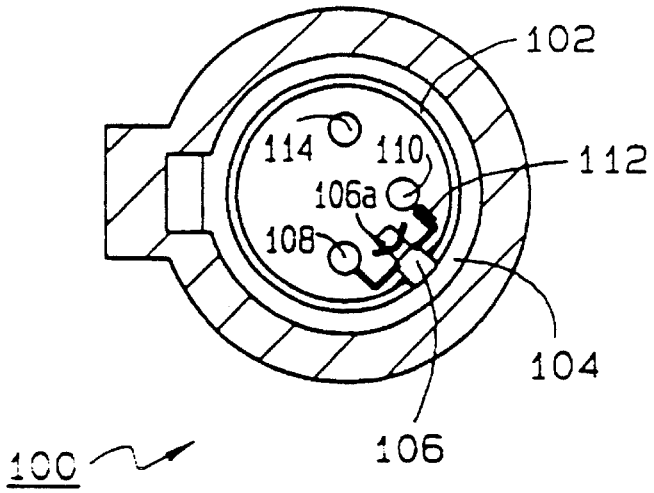
FIG. 4A is a cross-sectional end perspective of a female-type XLR connector according to the present invention in a connected position.
Figure 4B:
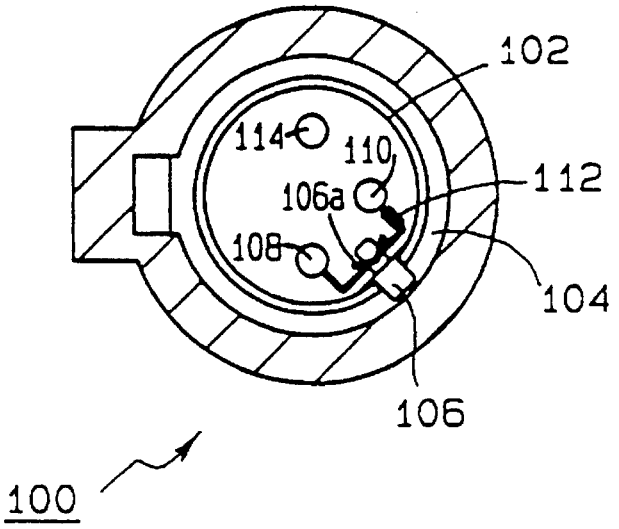
FIG. 4B is a cross-sectional end perspective of a female-type XLR connector according to the present invention in a disconnected position.

FIGS. 4A and 4B illustrate a female XLR connector 100 according to the first embodiment of the invention. The female XLR connector 100 has three hollow tubular-shaped terminals 108, 110, and 114 which are formed to mate with the pins of a male XLR connector, such as that shown in FIG. 1. A portion 104 of an inner periphery of the XLR connector 100 is removed and a switching member 106 is inserted therein. The switching member 106 is spring-biased outward in a radial direction. The switching member has an a conducting strip 106*a* formed thereon which opens and closes an electrical path between two of three hollow conductive terminals 108 and 110. An internal resistor 112 is placed in series between the terminal 108 and 110.

According to this arrangement, when the XLR connector 100 is attached to a male connector (not shown), the male connector exerts a force against the conducting member 106. This force pushes the conducting strip 106*a* away from the conductive portions which form the electrical path between terminals 108 and 110 thereby opening the path. Thus, when attached to a corresponding male XLR connector, the signals transmitted on the terminals 108 and 110 are isolated from each other and are coupled with corresponding pins on the male XLR connector 100.

As shown in FIG. 4B, when the XLR connector 100 is unattached from another XLR connector, the switching member 106 remains extended outward. This forces the conductive strip 106*a* to contact the conductive portions between the terminals 108 and 110 thereby closing a path between the terminals. The internal resistor 112 coupled in series along this path has a predetermined resistance which matches the impedance of the signal lines coupled to the terminals 108 and 110 (not shown). This permits the lines to be terminated properly when the XLR connector 100 is not attached to another XLR connector.

Figure 5A:
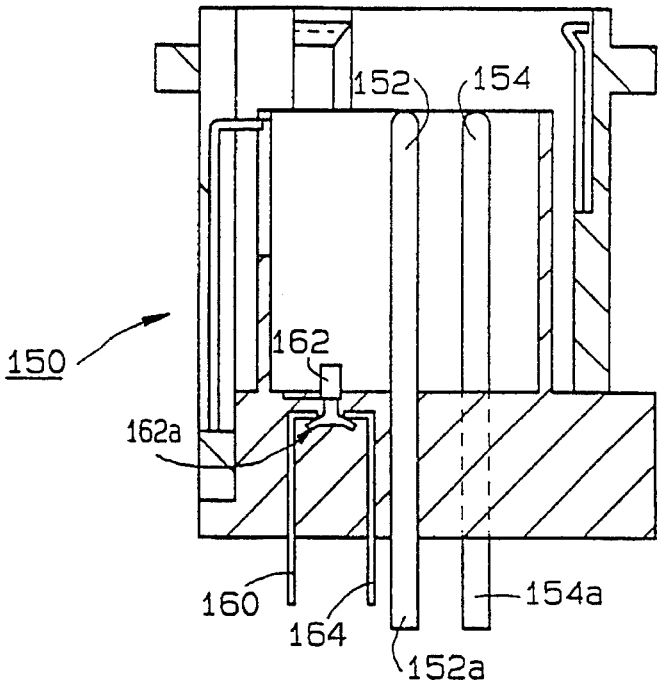
FIG. 5A is a cross-sectional side perspective of a male-type XLR connector in a connected position according to a second embodiment of the invention.
Figure 5B:
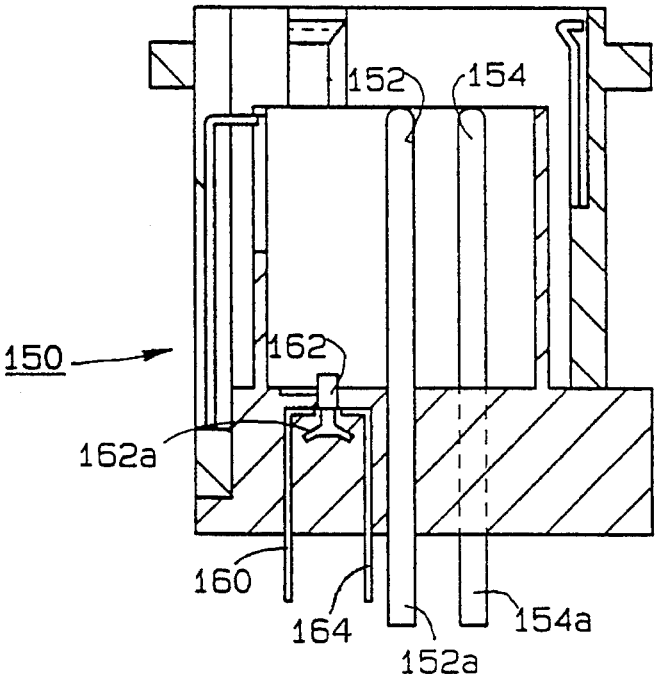
FIG. 5B is a cross-sectional side perspective of a male-type XLR connector in a disconnected position according to a second embodiment of the invention.

A second embodiment of the invention is represented in FIGS. 5A and 5B. While only male type XLR connectors according to this embodiment are shown, it will be apparent to those skilled in the art to construct female type connectors with corresponding features without departing from the spirit and scope of the invention.

FIG. 5A shows a cross-sectional perspective of a XLR connector 150 according to the second embodiment of the invention. Similar to view shown in FIG. 3A, the XLR connector 150 has three pins of which two are shown 152 and 154. The pins 152 and 154 each have respective end portions 152*a* and 154*a* which may be used as terminals for connection with signal lines from an attached device.

The XLR connector 150 includes a switching member 162 which is spring-biased in the direction I. The switching member 162 is placed in a gap between two conductive elements 160 and 164 which each have ends extending out from the XLR connector 150. Thus, the conductive elements 160 and 164 form an additional two terminals on the XLR connector 150 in addition to the conventional three terminals. As shown, the first and second terminals formed thereby are external to the XLR connector 150.

Similar to the switching member of the first embodiment, the switching member 162 has a conducting strip 162*a* formed thereon. This conducting strip closes an electrical path between the conductive elements 160 and 164 when the switching member 162 is biased in direction I. Thus, when the XLR connector 150 is unattached from a second XLR connector, the connecting conducting strip 162*a* closes a path between the conductive elements 160 and 164.

As shown in FIG. 5B, when the XLR connector 150 is attached to a second XLR connector (not shown), the switching member 162 is forced downward in a direction opposite to direction I, thereby opening the path otherwise formed by the conducting strip 162*a* between the conductive elements 160 and 164. Thus, according to this arrangement, it is possible to detect whether the XLR connector 150 is attached or unattached to a second XLR connector. This may be accomplished, by any technique which detects the potential difference between the terminals formed by conductive elements 160 and 164. If the XLR connector 150 is determined to be unattached, then steps may be taken to properly terminate the signal lines attached to the terminals of the XLR connector 150.

Figure 6A:
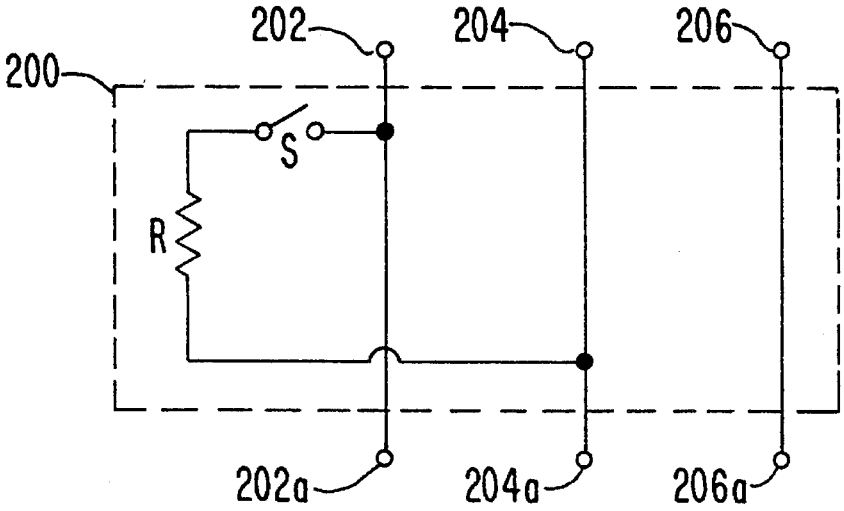
FIG. 6A is a schematic diagram of an XLR connector according to a first embodiment of the invention.

FIG. 6A is a schematic diagram representing the first embodiment of the invention. The area 200, which is encompassed by a dashed line, represents a XLR connector according to the invention. As shown, there are three terminals 202, 204, and 206 which represent either pins of a male connector or tubular terminals of a female connector. Each of the terminals 202, 204 and 206 has a respective end portion 202*a*, 204*a*, and 206*a* which form terminals which may be connected to wires leading to an external device.

According to the first embodiment of the invention, two of the terminals 202 and 204 are electrically coupled through a switch S and a resistor R. Switch S represents the switching member discussed above, while resistor R represents an internal resistor which is preselected to match the resistance of the signal lines which are coupled to terminals 202*a* and 204*a*.

Figure 6B:
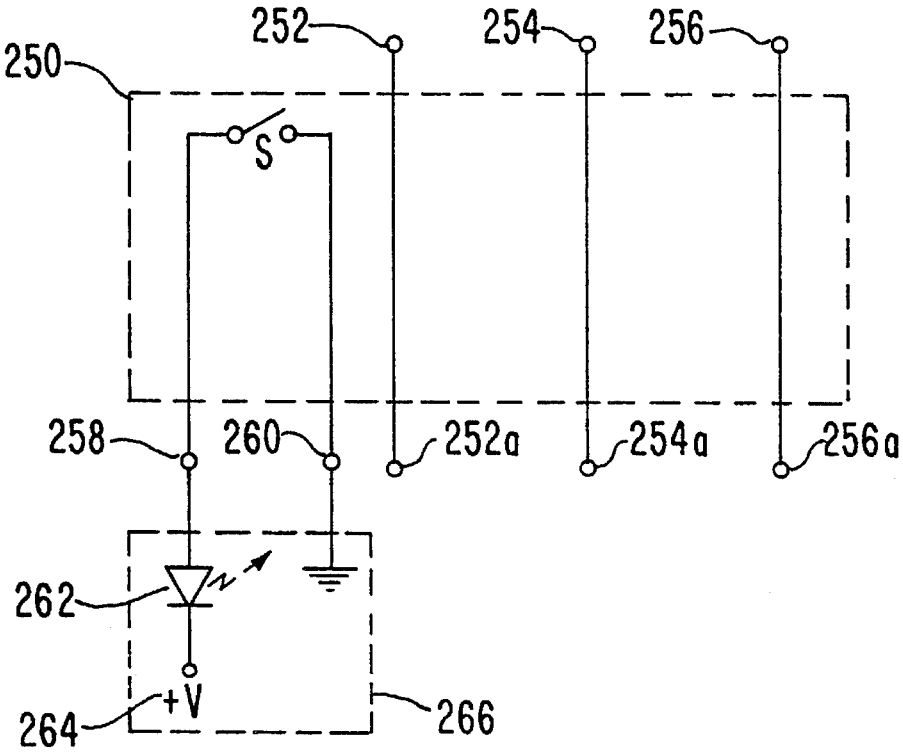
FIG. 6B is a schematic diagram of an XLR connector according to a second embodiment of the invention.

FIG. 6B is a schematic diagram of the second embodiment of the invention. The area 250 encompassed by a first dashed line represents a XLR connector. This XLR connector has three terminal 252, 254, and 256 which may be coupled with corresponding terminals on a second XLR connector. Each of these terminals 252, 254, and 256 have respective end portions 252*a*, 254*a*, and 256*a* which form terminals by,which an external device may be coupled with the XLR connector.

As shown in FIG. 6B, the XLR connector 250 has an additional two,terminals 258 and 260 coupled by a switch S. Thus, the switch S controls the potential difference between the terminals 258 and 260. The state of the switch S, that is open or closed, can be detected by detecting this potential difference. The circuit 266 shown in dashed lines illustrates an example by which such measurement can be accomplished.

Circuit 266 includes a light emitting diode (LED) 262 which coupled in series with a voltage source 264. The LED is connected to the terminal 258 while the terminal 260 is coupled to ground. Thus, when the switch S is closed, the LED emits light, thereby indicating that the switch is closed. When light is not emitted, it is shown that the switch is open. Accordingly, by including a detection circuit, for example, in an attached apparatus, an indication of the state of the XLR connector may be provided. Thus, it is not necessary for the user to physically inspect the state of the XLR connector.

Accordingly, the present invention provides a means for automatically terminating signal lines coupled to an XLR connector when the XLR connector is in an unattached state. It further provides a means for detecting the state of an XLR connector, that is whether the XLR connector is attached or unattached.

The foregoing is a detailed description of the preferred embodiments. The scope of the invention, however, is not so limited. Various alternatives will be readily apparent to one of ordinary skill in the art. The invention is only limited by the claims appended hereto.

What is claimed is:

1. A self-terminating XLR connector device, matably connectable to a second connector device, comprising:

a housing;

a plurality of male pins terminals positioned in said housing each having a first portion for matably attaching to a corresponding terminal of the second connector device and a second portion for establishing an electrical connection with a signal line;

and a movable switching member positioned in said housing and on one side of said plurality of male pin terminals for detecting when said self-terminating XLR connecting device is matably connected with the second connecting device, said movable switching member having a first position when said self-terminating XLR connecting device is matably connected to the second connector device and a second position when said self-terminating XLR device is unconnected to the second connecting device;

wherein said movable switching member opens an electrical path between first conductive element and a second conductive element when in said first position, and closes said electrical path when in said second position;

said self-terminating XLR connector device further comprising an internal resistor located along said electrical path in series with said switching member and in said housing.

2. The self-terminating XLR connector device of claim 1 wherein said first conductive element is coupled to a first of said plurality of terminals and said second conductive element is coupled to a second of said plurality of terminals.

3. The self-terminating XLR connector device of claim 1 wherein said internal resistor has a resistance with is substantially equal to an internal impedance of a signal line connected to said second portion of said first of said plurality of terminals.

4. The self-terminating XLR connector device of claim 1 wherein said switching member includes a conducting strip which opens said electrical path when said switching member is in said first position, and closes said electrical path when said switching member is in said second position.

5. A XLR connector device, matably connectable to a second connector device, comprising:

a housing;

a plurality of male pins terminals positioned in said housing each having a first portion for matably attaching to a corresponding terminal of the second connector device and a second portion for establishing an electrical connection with a signal line;

and a movable switching member positioned in said housing and on one side of said plurality of male pin terminals for detecting when said XLR connecting device is matably connected with the second connecting device, said movable switching member having a first position when said XLR connecting device is matably connected to the second connector device and a second position when said XLR device is unconnected to the second connecting device;

wherein said movable switching member opens an electrical path between a first conductive element and a second conductive element when in said first position, and closes said electrical path when in said second position;

wherein said first conductive element forms a first external terminal and said second conductive element forms a second external terminal both of which are maintained electrically isolated from said second connector device, and wherein a potential difference between said first external terminal and said second external terminal is substantially infinite when said switching member is in said first position and is substantially zero when said switching member is in said second position.

6. The XLR connector device of claim 5 wherein said first external terminal and said second external terminal are connected to means for detecting said potential difference.

7. The XLR connector device of claim 6 wherein said means for detecting said potential difference includes a LED which visually indicates whether said switching member is in said first position or in said second position.

8. The XLR connector device of claim 5 wherein said switching member includes a conducting strip which opens said electrical path when said switching member is in said first position, and closes said electrical path when said switching member is in said second position.

* * * * *